US005551115A

United States Patent [19]

Newville

[11] Patent Number: 5,551,115

[45] Date of Patent: Sep. 3, 1996

[54] BRUSH HEAD ADAPTED FOR MECHANICAL OR MANUAL ENGAGEMENT

[76] Inventor: Duane H. Newville, 6242 3rd Ave. South, St. Petersburg, Fla. 33707

[21] Appl. No.: 407,157

[22] Filed: Mar. 20, 1995

[51] Int. Cl.[6] ..... A46B 5/02

[52] U.S. Cl. ..... 15/172; 15/143.1; 15/144.2; 15/145; 15/159.1; 403/114

[58] Field of Search ..... 15/144.1, 144.2, 15/145, 172, 176.1, 176.6, 159.1; 16/111 R, 114 R, DIG. 41; 403/76, 114, 122, 131

[56] References Cited

U.S. PATENT DOCUMENTS

| | | | |
|---|---|---|---|
| 47,927 | 5/1865 | Burtnett | 15/144.2 |
| 320,436 | 6/1885 | Hock | 15/144.2 |
| 366,790 | 7/1887 | Orther | 15/144.2 |
| 1,171,738 | 2/1916 | Mallet | 15/144.1 |
| 2,546,387 | 3/1951 | Coffing | 16/114 R |
| 3,006,011 | 10/1961 | Littleton | 15/144.2 |
| 4,247,216 | 1/1981 | Pansini | 15/145 |
| 5,412,835 | 5/1995 | Vosbikian et al. | 15/144.1 |

FOREIGN PATENT DOCUMENTS

| | | | |
|---|---|---|---|
| 734088 | 10/1932 | France | 15/144.2 |
| 1632378 | 11/1970 | Germany | 15/144.2 |

*Primary Examiner*—David Scherbel
*Assistant Examiner*—Terrence R. Till
*Attorney, Agent, or Firm*—Joseph C. Mason, Jr.; Ronald E. Smith

[57] ABSTRACT

A brush assembly includes a brush head that is releasably attached to a first elongate handle when a remote area is to be reached and which is releasably attached to a second palm-held handle when the elongate handle is not required. The assembly includes a ball and socket joint. The elongate handle is detachably secured within a blind bore formed in the ball. The socket is defined by a plurality of circumferentially spaced apart curved retainers that are spaced apart from one another by a distance sufficient to receive the elongate handle when the handle is held at an angle relative to the brush head. Thus, the brush head does not rotate with respect to the handle when the brush is in use. When the elongate handle is detached from the ball, each of the respective spaces between the retainers is sufficient to receive respective circumferentially spaced apart fingers that collectively form the palm-held handle, and the structure is comfortably held in the palm so that the brush can be used without the elongate handle. In second and third embodiments, a second and a third groove are formed in the ball, respectively, for sliding engagement with a post formed in the socket to enable a brush user to tilt and maintain the brush head on an edge.

10 Claims, 12 Drawing Sheets

BRUSH HEAD ADAPTED FOR MECHANICAL OR MANUAL ENGAGEMENT

BACKGROUND OF THE INVENTION

1. Field of the Invention

This invention relates, generally, to brushes and scrub pads. More particularly, it relates to a brush head construction that selectively enables mechanical or manual engagement.

2. Description of the Prior Art

Hand held brushes are well known, as are brushes mounted at the distal free end of an elongate tubular handle.

However, the art heretofore has not produced a brush that may be handle-held or hand-held at the selection of its user.

There is also a need for a handle-held brush held that is positionable in both a horizontal and vertical disposition when in use, and which maintains its disposition relative to the handle as it is being used.

Heretofore, as disclosed in U.S. Pat. No. 320,436 to Hock, a brush handle construction was provided that prevented an elongate handle from rotating about the longitudinal axis of the handle then in use, but the construction did not enable the brush head to be fixed in a vertical or a horizontal alignment at the selection of the user. Moreover, the construction did not enable conversion of the handle-held apparatus into a manually-held apparatus, In view of the prior art in the field of this invention at the time the present invention was made, it was not obvious to those of ordinary skill in this art that a brush head adapted for selective mechanical or manual use was desirable, or how such a structure could be provided if the desirability thereof had been perceived.

Moreover, it was not obvious that a nonrotatable handle-held brush head adapted for horizontal of vertical use should be provided, or how such a brush head could be provided if such need had been appreciated.

SUMMARY OF THE INVENTION

The novel brush head of this invention includes a generally rectangular base having a first surface to which a plurality of bundles of bristles that collectively form a conventional brush or scrub pad is mounted. It further includes a second surface having a centrally disposed ball-trapping socket integrally formed therewith.

The socket is highly novel in that it is formed by four equidistantly and circumferentially spaced apart retainers, each of which is curved radially inwardly so that a rotatable ball is surrounded by said retainers and trapped therebetween.

The ball has a handle-receiving blind bore formed therein for receiving the distal end of an elongate handle. The ball also has a throughbore formed therein to receive a locking pin that releasably connects the handle to the ball. The axis of the blind bore and the throughbore are normal to one another.

A self-biased locking device is positioned within the hollow interior of the elongate tubular handle. The locking device is "V"-shaped and has two legs that are biased away from one another. A pair of outwardly extending locking pins are integrally formed on a preselected leg of the pair of legs and a pair of apertures are formed in the distal end of the elongate handle; said apertures respectively receive their associated locking pins when the locking device is in repose.

A first locking pin of said pair of locking pins is releasably engageable with the throughbore formed in the ball.

The second locking pin is disposed in greater spaced relation to the distal free end of the elongate handle than said first pin so that said second locking pin remains outside the ball and socket assembly when the distal free end of the handle is fully received within the blind bore formed in the ball. The first and second locking pins are connected to one another because they are both mounted on the same leg of the self-biased locking device as aforesaid; accordingly, depression of the second pin also depresses the first pin, thereby withdrawing said first pin from said throughbore and thus disengaging the distal end of the handle from the ball.

The spacing between the curved retainers is substantially equal to the diameter of the elongate handle. Accordingly, when the longitudinal axis of the handle is disposed normal to the plane of the brush holder, the brush is free to rotate three hundred and sixty degrees in the plane of the brush holder, i.e., about the longitudinal axis of the elongate handle. However, when the angle between the longitudinal axis of the handle and the plane of the brush holder is acute so that the handle enters into a preselected a space between two circumferentially contiguous retainers, said retainers prevent rotation of said brush handle about its longitudinal axis but allow sliding movement of said brush handle in said preselected space between the retainers so that the angular relation between the brush handle and the plane of the brush head varies as the brush is used. Since there are four retainers disposed in equidistantly and circumferentially spaced relation to one another, the handle may assume only four positions when it is disposed in angular relation to the brush head.

Significantly, the spaces between the retainers are aligned with the longitudinal and transverse axes of the brush head. Thus, the handle is restricted to angular positions where it is disposed in alignment with said axes. This enables the user of the novel structure to align the brush head in a vertical alignment to facilitate scrubbing of relatively narrow spaces, or to align the brush head in a horizontal alignment to facilitate scrubbing of relatively wide spaces. Regardless of which alignment is selected, the brush head cannot rotate with respect to the longitudinal axis of the elongate handle as long as the brush head remains flat on the surface being scrubbed.

However, if a user tilts the brush head on its transverse or longitudinal edge in an effort to apply the edge of the brush into a hard to reach place, the ball will rotate and the brush head will return to its untilted configuration because there is no structure to prevent relative rotation between the ball and socket in such a configuration of the brush head.

Accordingly, in a second embodiment, a truncate upstanding post is formed in the bottom of the socket, centrally thereof, and a first groove that slidingly receives said post along its extent is formed in the ball. The groove extends half way around the ball, i.e., in a one hundred eighty degree arc or great circle path of travel along the bottom of the ball, i.e., the side oposite the blind bore. The elongate handle is thus free to rotate relative to the brush head in a plane defined by the longitudinal axis of the groove.

When the brush head is positioned in its vertical orientation, i.e., with said elongate handle being in alignment with the longitudinal axis of the brush head, the post prevents rotation of the ball relative to the socket when the brush head is tilted onto one of its longitudinal edges. This enables a user cleaning a narrow place with the brush head in its vertical orientation to tilt the brush head onto a longitudinal edge so that brush edges can reach into a hard to reach place.

In a third embodiment, a second groove, normal to the first, is formed in said bottom of said ball in intersecting relation to the first groove. When the brush head is positioned in its horizontal disposition, i.e., with said elongate handle being in alignment with the transverse axis of the brush head, the post and the second groove prevent rotation of the ball relative to the socket when the brush head is tilted onto one of its transverse edges. This enables a user cleaning a wide place with the brush head in its horizontal orientation to tilt the brush head onto a transverse edge so that brush edges can reach into a hard to reach place.

In all three embodiments, when the elongate handle is disenaged from the ball, a dome-shaped, palm-fitting handle is attached to the socket so that the brush may be manipulated by hand. The dome-shaped handle has as many fingers as the socket has spaces between retainers and the breadth of the fingers substantially equals the breadth of the associated spaces so that a snug fit is achieved between said fingers and retainers when the dome-shaped handle is attached to the socket. The shape of the handle provides for a comfortable fit in the palm of the user's hand.

It is an important object of this invention to provide a brush head that may be manipulated manually or mechanically.

Another important object is to provide a brush head that does not rotate with respect to the longitudinal axis of a handle when the brush is in use.

Another object is to provide a means for facilitating quick release of a brush head from a handle so that it is easy to switch from mechanical to manual manipulation of the brush head or vice versa.

Still another object is to provide a structure that enables a user to tilt a brush head on an edge so that the edges of a brush may be used effectively.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
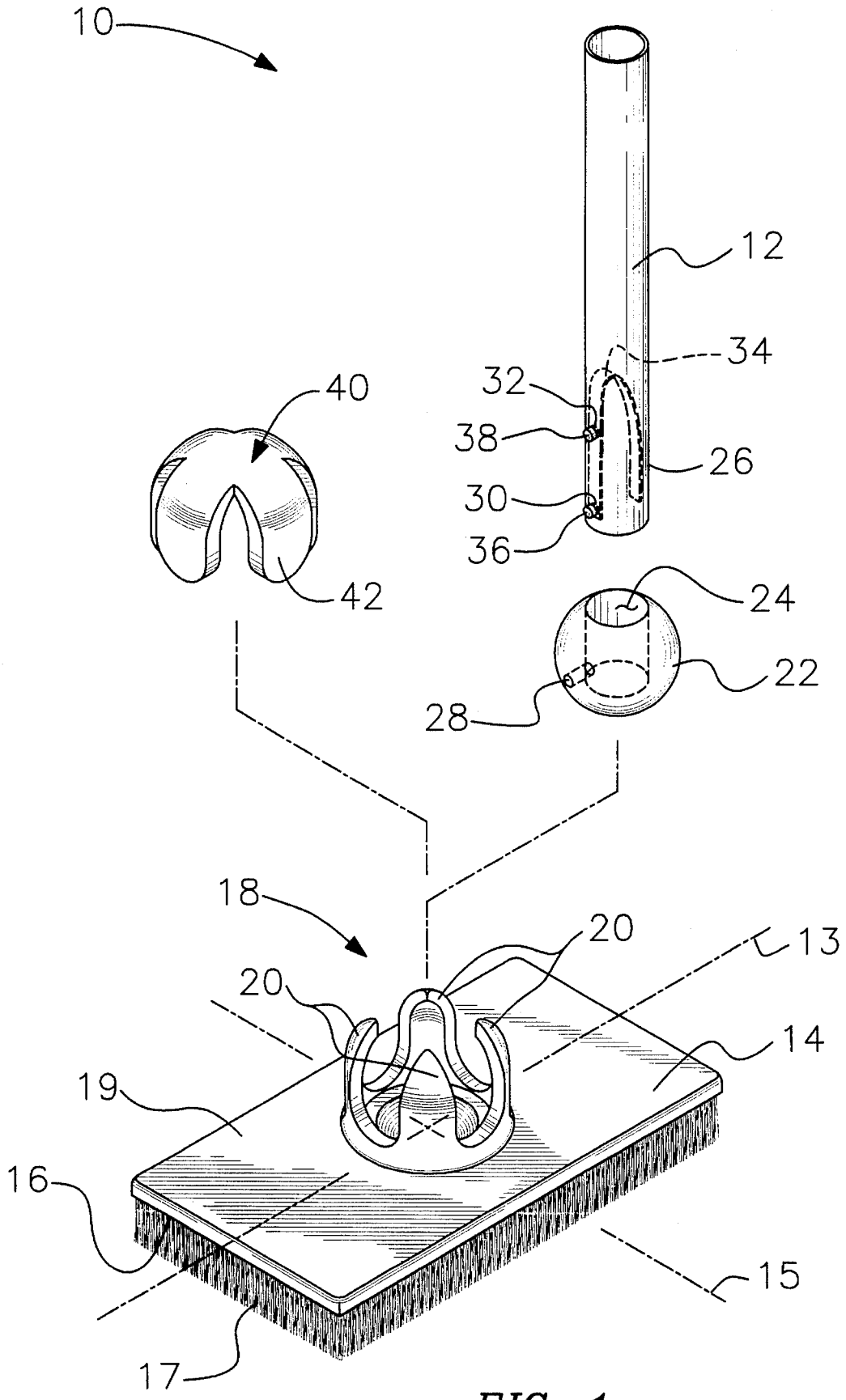
FIG. 1 is an exploded perspective view of all of the structural parts of this invention.

Referring now to FIG. 1, it will there be seen that an illustrative embodiment of the invention is denoted as a whole by the reference numeral 10.

Brush assembly 10 includes an elongate tubular handle 12 and a brush head 14 having a longitudinal axis of symmetry 13 and a transverse axis of symmetry 15. Brush head 14 has a first side 16 adapted for mounting a brush 17 thereon.

A ball-retaining socket 18 is defined by a plurality of circumferentially and equidistantly spaced apart retainers, collectively denoted 20, formed on a second side 19 of said brush head, each of said retainers having a radially inwardly directed curvature as depicted.

When the inventive assembly is in use, ball 22 is disposed in surrounded relation to retainers 20 which frictionally grip said ball. Ball 22 is captively rotatable within the socket defined by said retainers.

A blind bore 24 is formed in ball 22; it slidingly receives distal end 26 of elongate handle 12. Alternatively, blind bore 24 may be internally threaded to receive an externally threaded handle, or it may be tapered to releasably receive said handle in the well-known way.

A throughbore 28 of smaller diameter than blind bore 24 is also formed in ball 22; the respective axes of symmetry of the blind bore and the throughbore are normal to one another.

First and second apertures, denoted 30, 32, are formed in elongate handle 12 near its distal free end as depicted. A self-biased locking device 34, having first and second pins 36 and 38 mounted on one leg thereof, is positioned within the hollow interior of handle 12 so that said pins extend through said first and second apertures 30 and 32, respectively. The pins are biased radially outwardly by locking device 34 so that they extend through said apertures when in repose.

Figure 2:
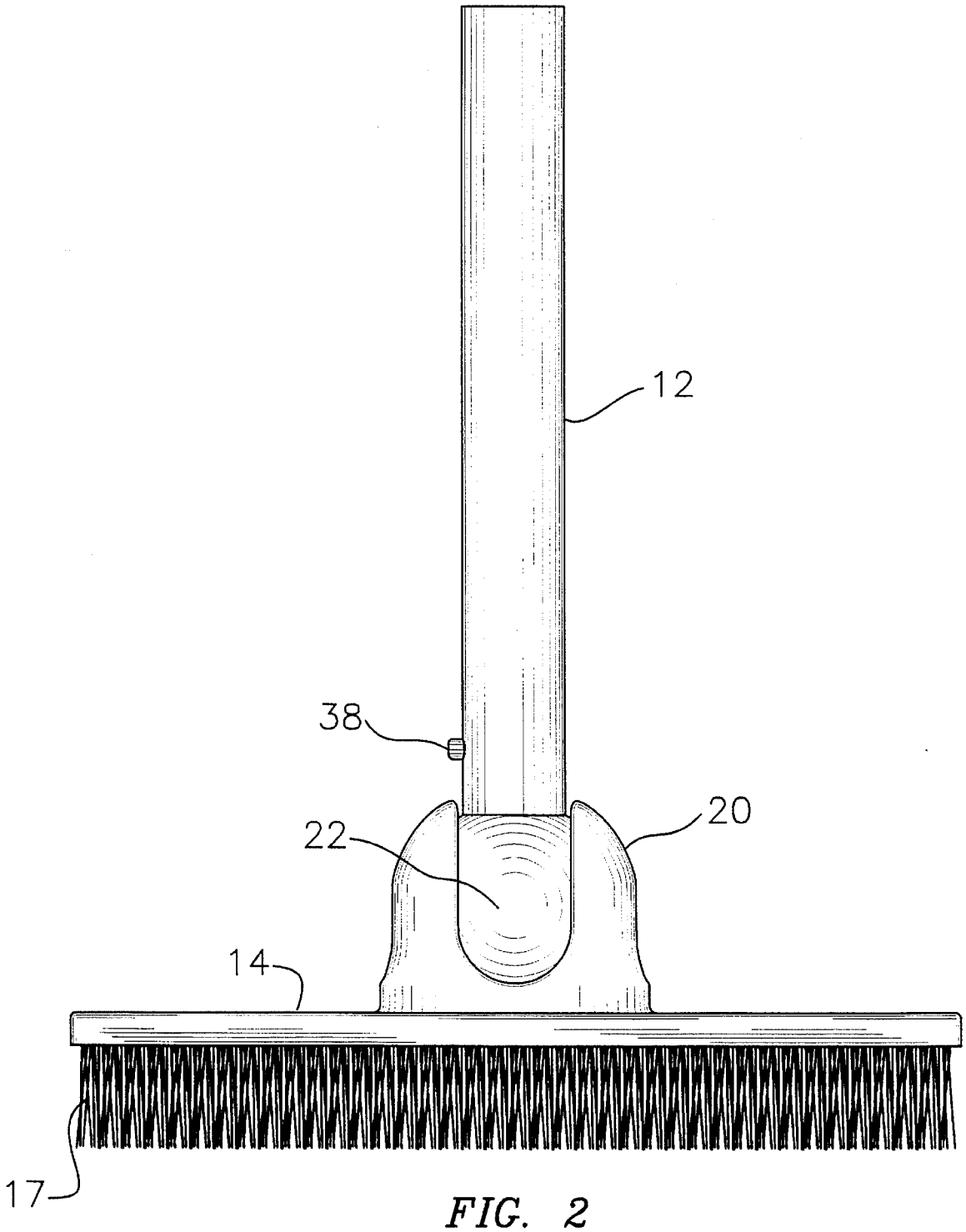
FIG. 2 is a side elevational view depicting the elongate handle and ball of this invention engaged to one another and with the locking means that secures said parts to one another in repose.
Figure 3:
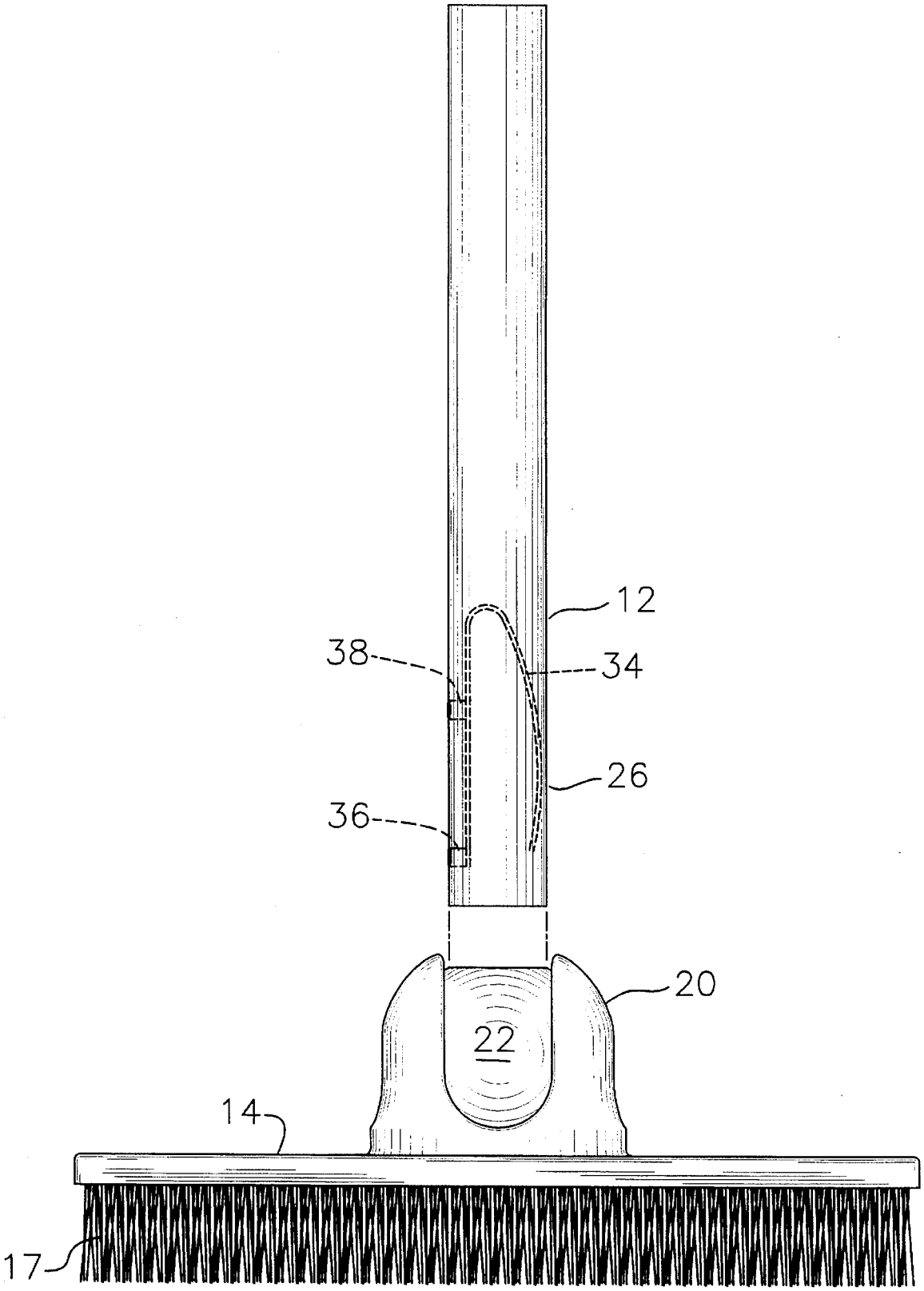
FIG. 3 is a view similar to FIG. 2, but with the locking means manually depressed to disengage said elongate handle and ball from one another.

Thus, when the distal free end of handle 12 is inserted into blind bore 24, first pin 36 engages throughbore 28 formed in ball 22 and second pin 38 remains outside said ball and socket structure as depicted in FIG. 2. Depressing second pin 38 thus depresses first pin 36 to disengage handle 12 from ball 22 as depicted in FIG. 3.

Figure 4:
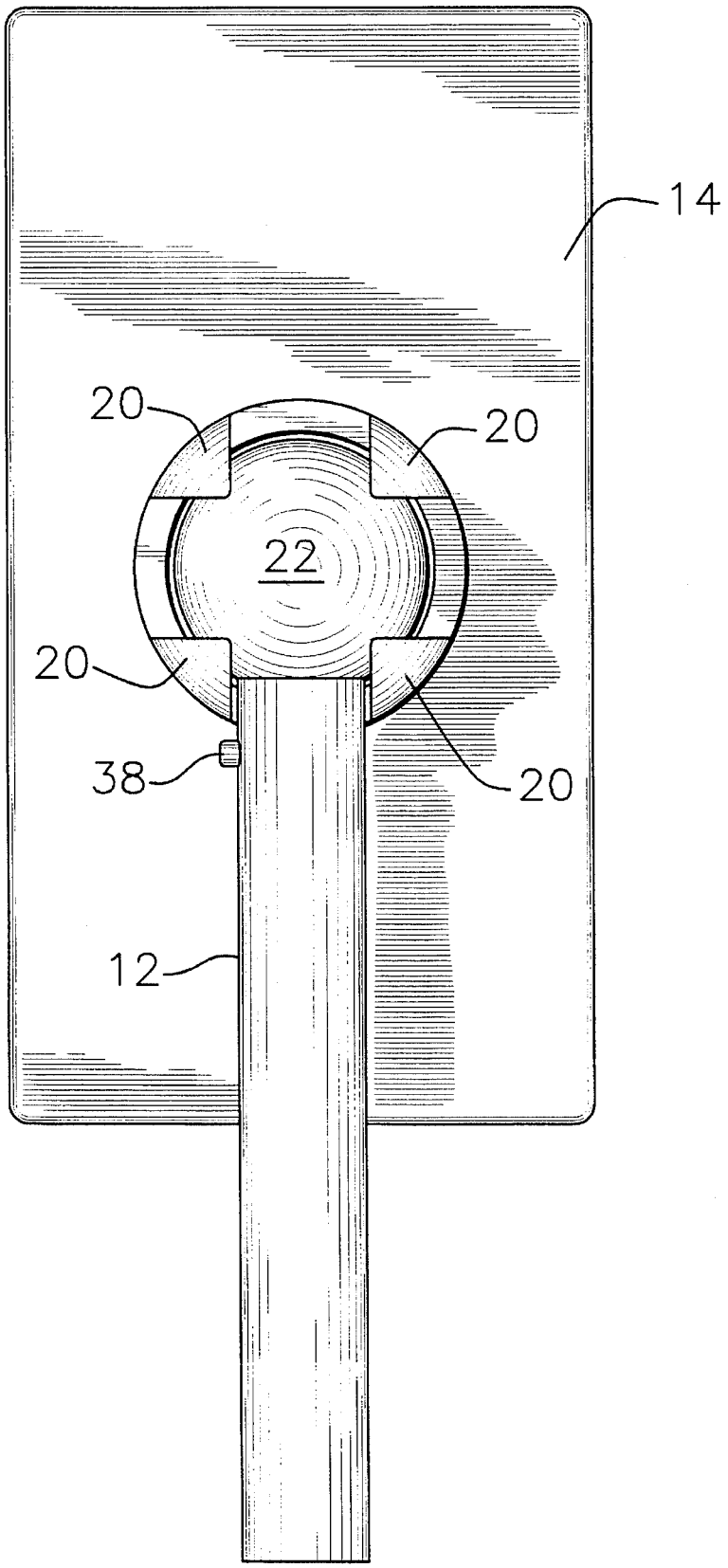
FIG. 4 is an elevational view depicting the device in use to clean a narrow, remote space.
Figure 5:
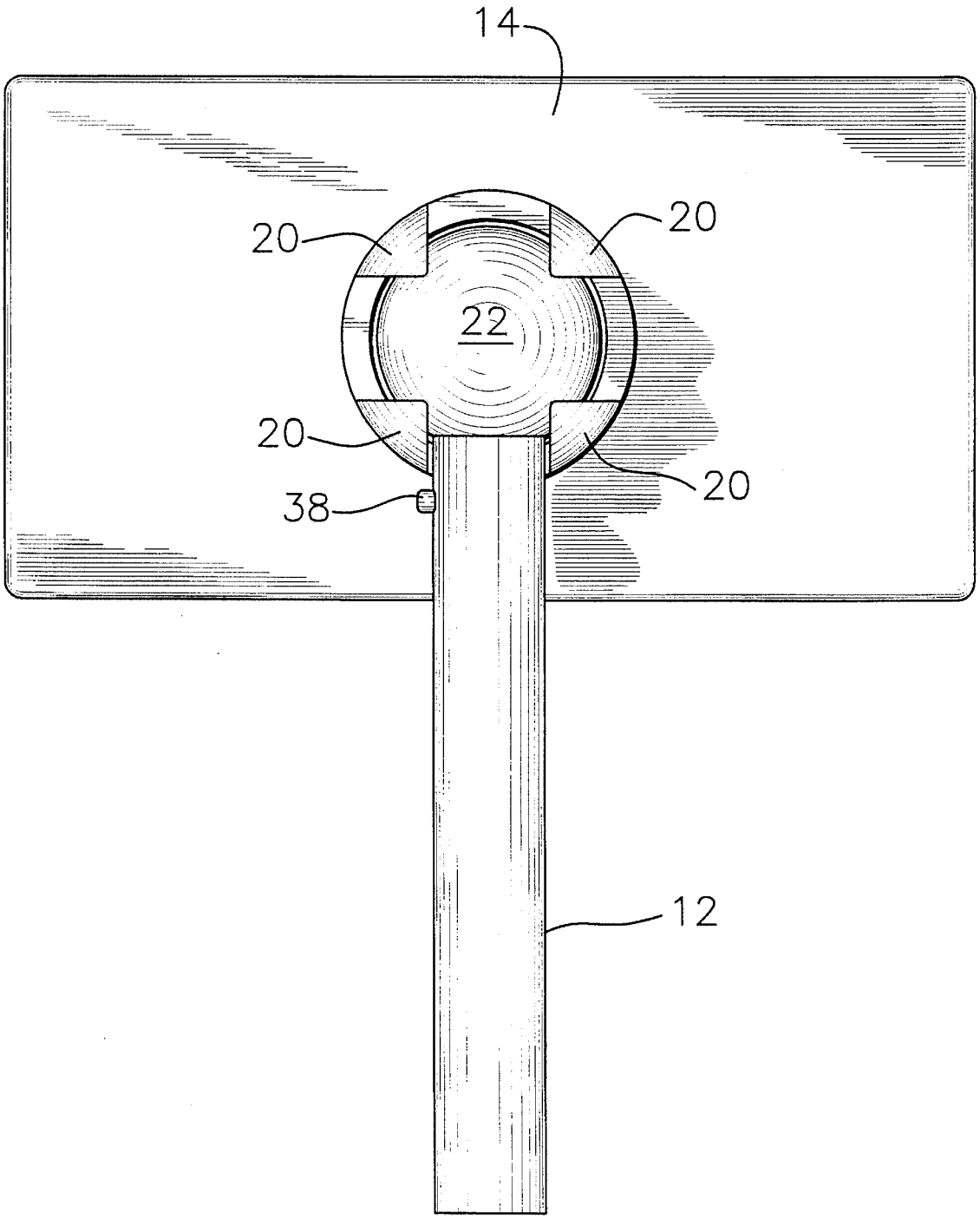
FIG. 5 is an elevational view depicting the device in use to clean a wide, remote space.

Retainers, collectively denoted 20, are circumferentially spaced apart from one another by a space sufficient to receive therebetween handle 12 when a longitudinal axis of the handle is disposed in acute angular relation to a plane of brush head 14 as depicted in FIGS. 4 and 5.

Accordingly, brush head 14 cannot rotate with respect to handle 12 when said handle is received between a pair of contiguous retainers. Thus, when the brush head is vertically oriented for cleaning a narrow space, as depicted in FIG. 4, the brush head will remain in the depicted position as it is used and will not rotate with respect to the longitudinal axis of symmetry of handle 12, and when the brush head is horizontally oriented for cleaning a wider space, as depicted in FIG. 5, the brush head will remain in said position relative to the longitudinal axis of handle 12.

Figure 6:
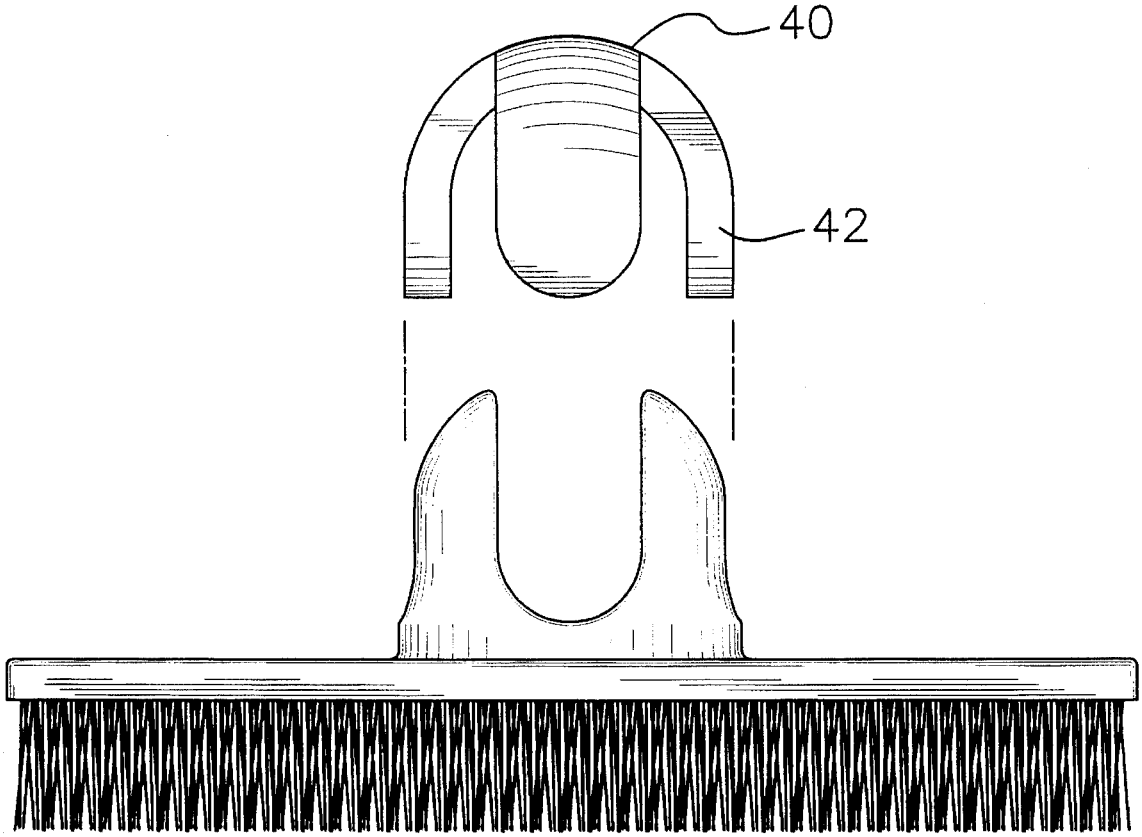
FIG. 6 is an exploded side elevational view depicting the curved retainers of the brush head and the curved fingers of the manual hand grip of this invention in spaced relation to one another.

FIG. 6 depicts a second, dome-shaped handle 40 for releasably engaging socket 18 when elongate handle 12 is disengaged from ball 22.

Second handle 40 includes a plurality of curved fingers, collectively denoted 42, that releasably fit within the respective spaces between retainers 20 so that when elongate handle 12 is disengaged from ball 22, second handle 40 may be placed into engagement with said socket.

Fingers 42 are integral with one another at respective proximal ends thereof. As best understood in connection with FIG. 7, there are four fingers, each disposed ninety degrees from its contiguous fingers as depicted. The breadth of each finger 42 is about the same as the breadth of the space between contiguous retainers 20. Accordingly, when fingers 42 are inserted between retainers 20, a snug fit is achieved. If brush head 14 is grasped and inverted, fingers 42 will not separate from retainers 20 under the force of gravity. However, intentional separation of said parts from one another is easily achieved because the grip therebetween is not difficult to overcome. Thus, transforming the assembly back into a brush head having elongate handle 12 is a very simple procedure that requires only a few seconds of time.

Figure 7:
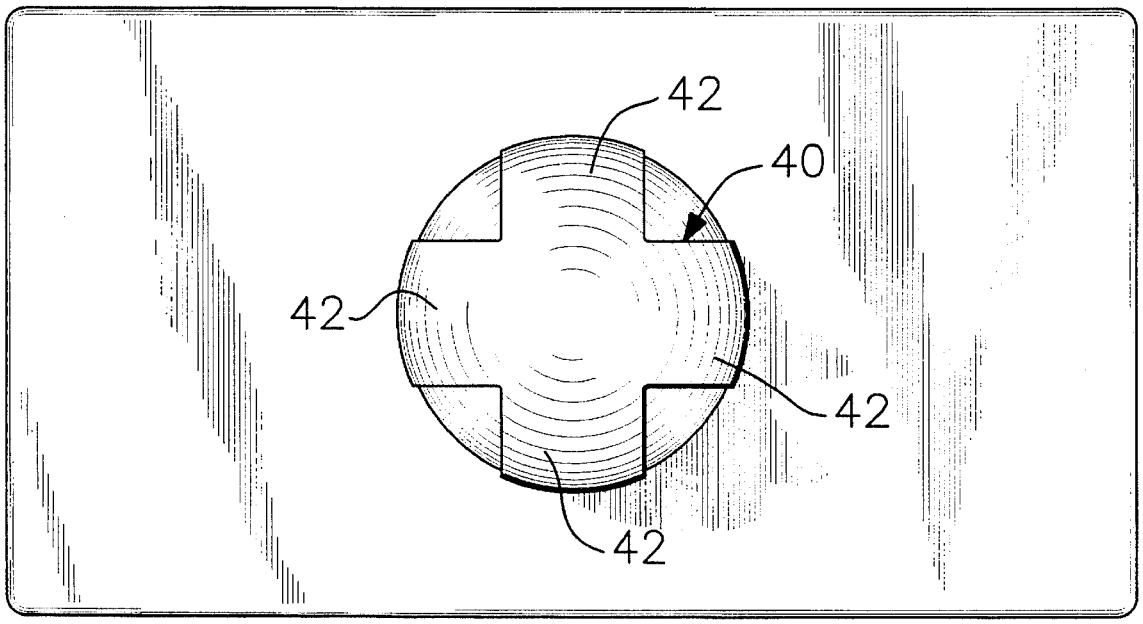
FIG. 7 is a top plan view of the structure depicted in FIG. 6 when the retainers and fingers are interlocked with one another.

When in the configuration of FIGS. 6 and 7, brush head 14 is easy to manipulate manually. Retainers 20 and fingers 42 collectively form a hemispherical dome structure that fits comfortably in the palm of a hand.

Figure 8:
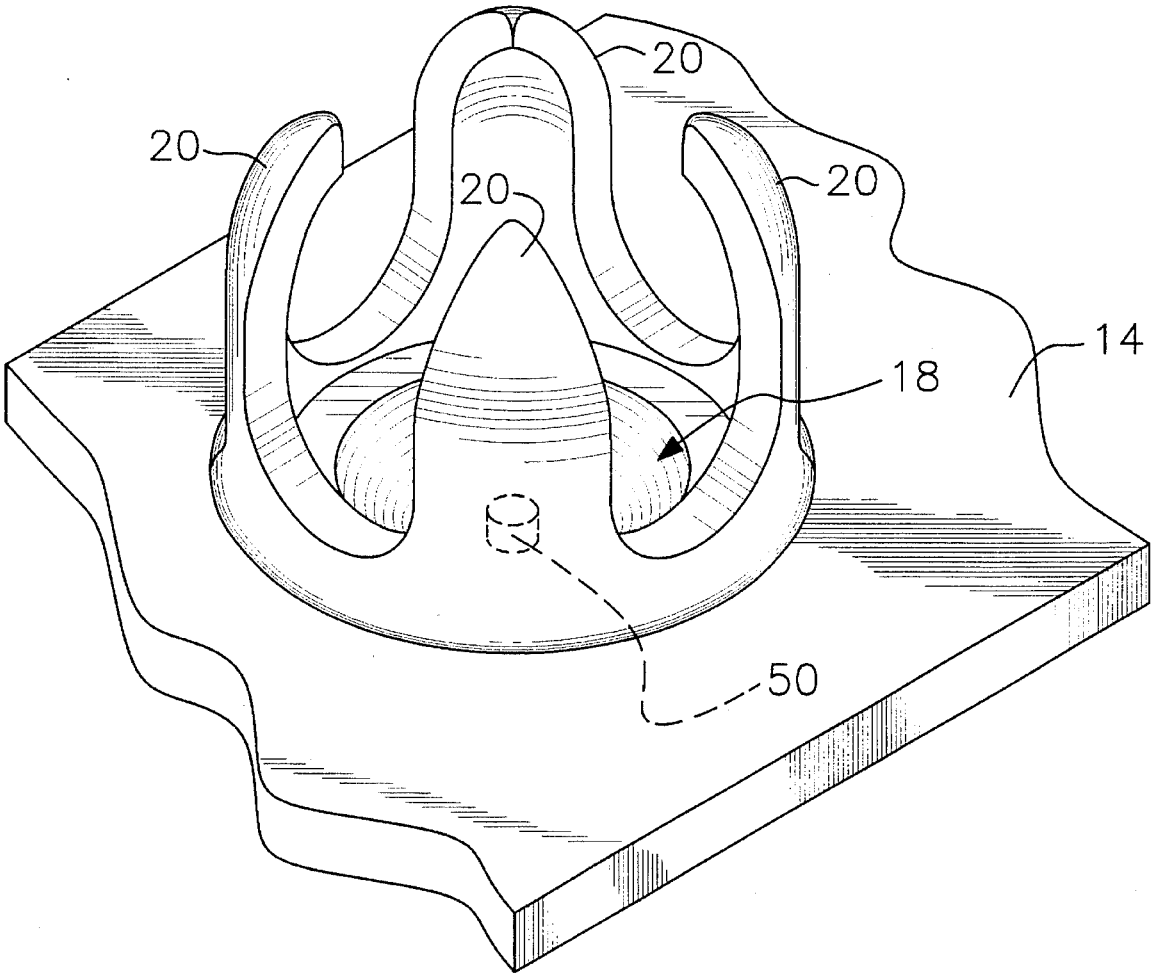
FIG. 8 is a perspective view of a second embodiment of the socket of this invention.
Figure 8A:
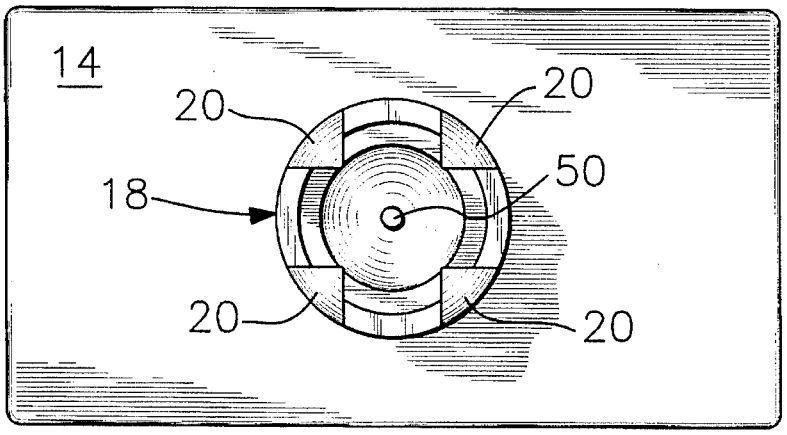
FIG. 8*a* is a top plan view of the structure depicted in FIG. 8.

In a second embodiment of the invention, an upstanding truncate post 50 is formed integrally with the bottom of socket 18, centrally thereof as depicted in FIGS. 8 and 8*a*.

Figure 9:
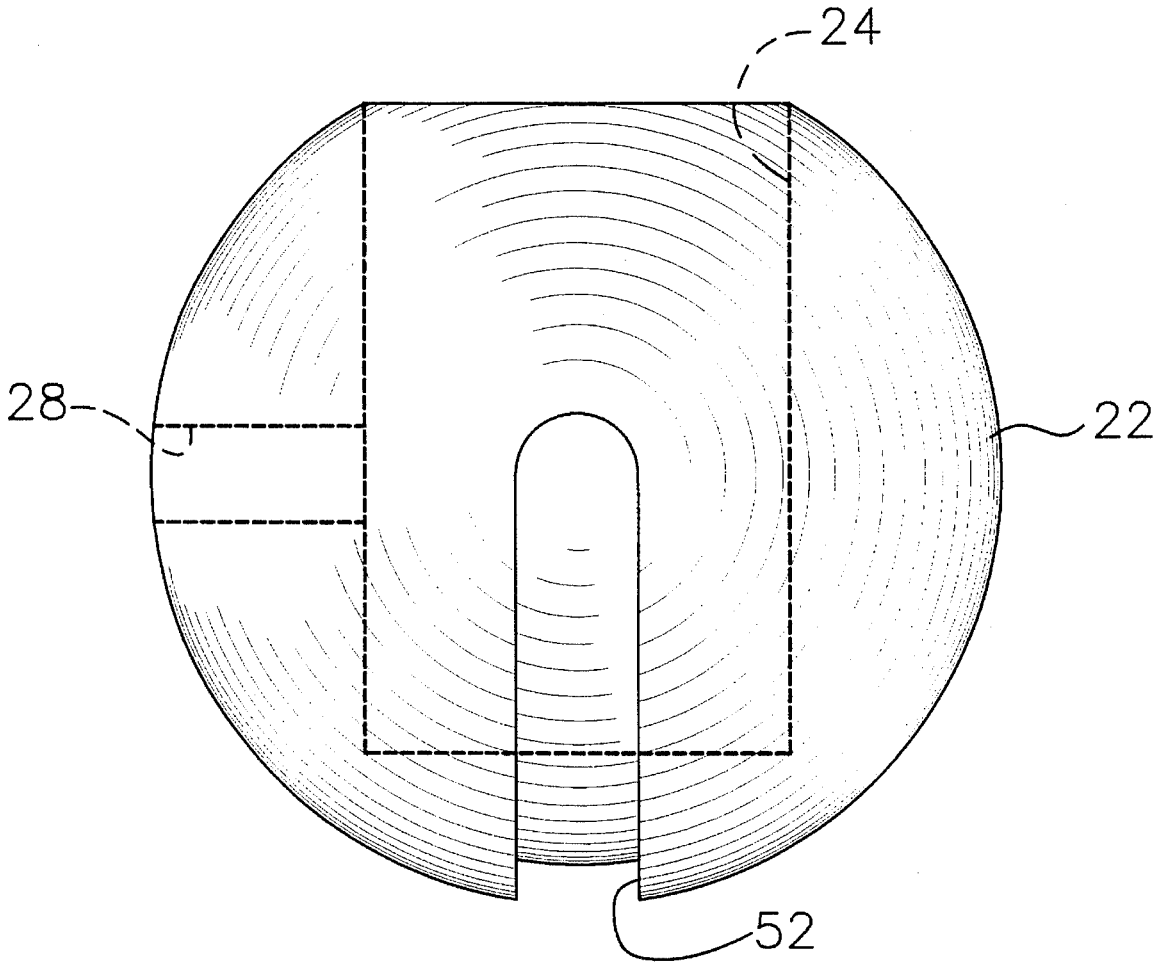
FIG. 9 is a side elevational view of a second embodiment of the ball of this invention.

Post 50 is slideably received within groove 52 (FIG. 9) when ball 22 is positioned within socket 18. Groove 52 extends along a great circle of the ball for an extent of about one hundred eighty degrees, i.e., about half way around the ball, on the side thereof opposite blind bore 24. When brush head 14 is disposed in a horizontal plane and elongate handle 12 is disposed in a vertical plane, groove 52 may be said to be formed in a bottom of ball 22.

Figure 10:
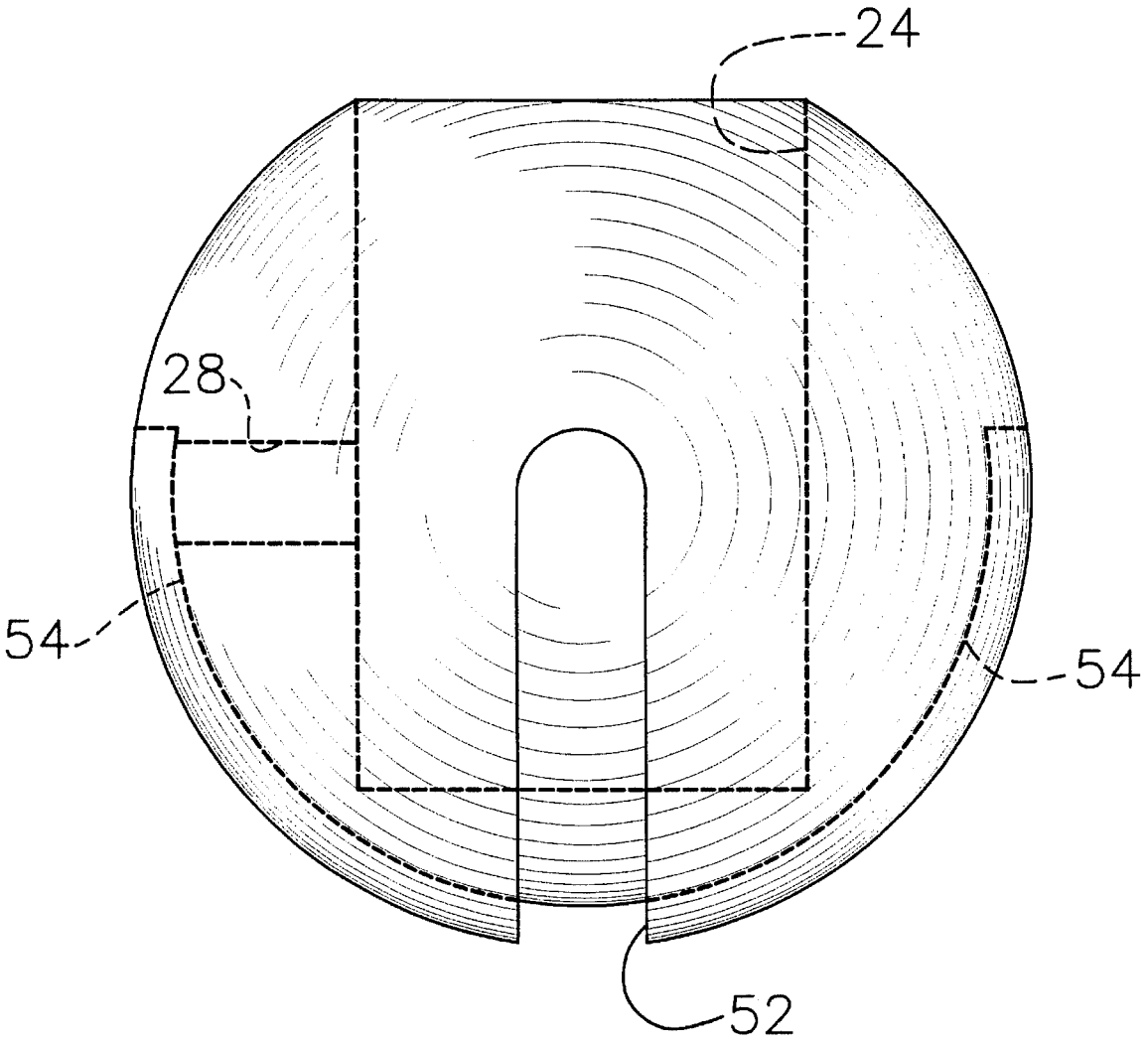
FIG. 10 is a side elevational view of a third embodiment of the ball of this invention.

In a third embodiment of the invention, disclosed in FIG. 10, post 50 may also be slideably received within a second groove 54 having the same construction as groove 52 but which is disposed in perpendicular, intersecting relation thereto.

Figure 11:
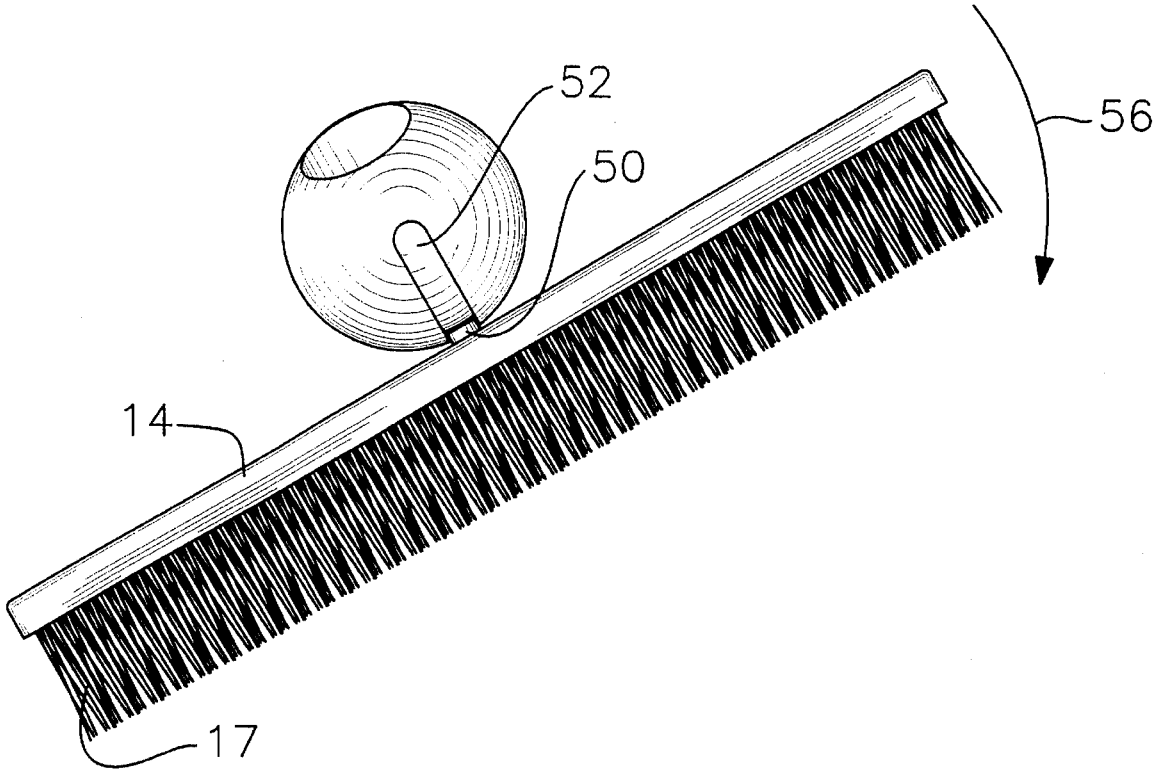
FIG. 11 is a side elevational view of the second embodiment of this invention when the brush head is tilted onto a transverse edge.
Figure 12:
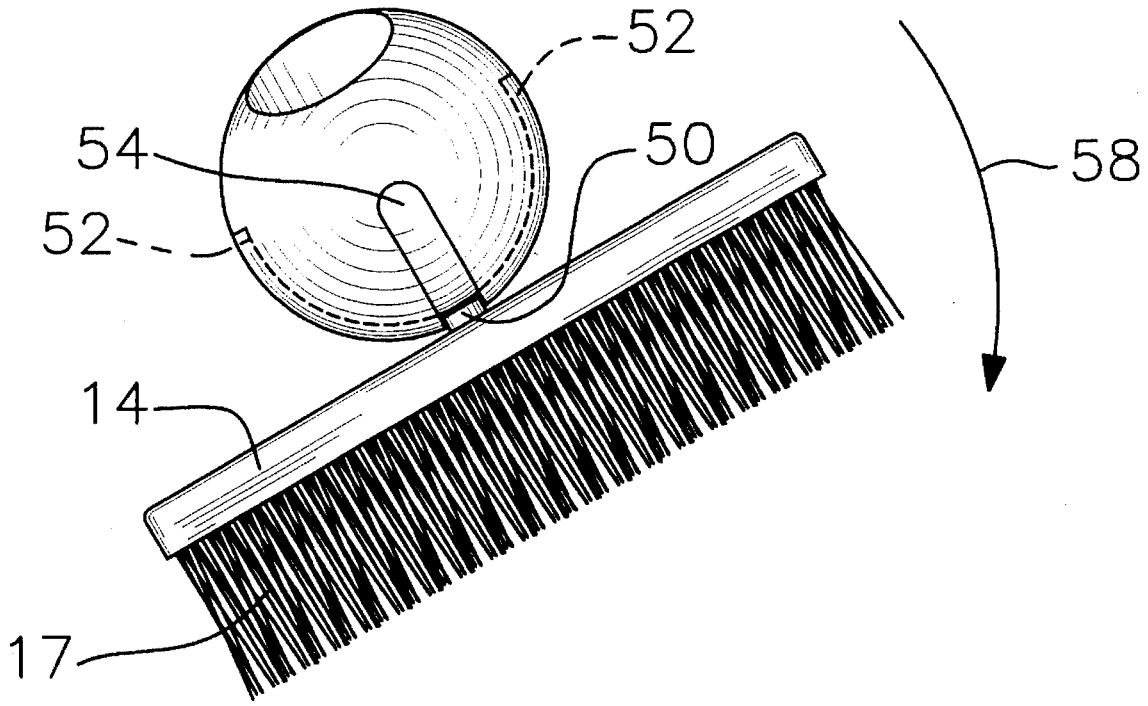
FIG. 12 is a side elevational view of the third embodiment of the invention when the brush head is tilted onto a longitudinal edge.

The utility of groove 52 is perhaps best understood in connection with FIG. 11, and the utility of groove 54 is perhaps best understood in connection with FIG. 12. FIG. 11 depicts the brush head when tilted onto a transverse edge, and FIG. 12 depicts the brush head when tilted onto a longitudinal edge. In each case, the engagement of most 50 and slot 52 or 54, respectively, prevents rotation of ball 22 in the direction indicated by the reference numeral 56 in FIG. 11 and 58 in FIG. 12. In the absence of the post and groove connection, the brush head would rotate in the directions indicated by said directional arrows whenever a user attempted to tilt said brush head into the depicted configurations in an effort to utilize an edge of the brush. In other words, the tilted dispositions of the brush head depicted in FIGS. 11 and 12 could not be maintained with the ungrooved ball and the postless socket of the first embodiment because the ball would simply rotate with respect to the socket until the brush head lay flat upon the surface being cleaned. The engagement of the handle 12 between retainers 20 prevents rotation of the brush head as above-described when the brush head is maintained flat on the surface being scrubbed, but said engagement alone cannot defeat relative rotation between the ball and socket when the brush head is tilted as depicted in said FIGS. 11 and 12.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A brush assembly, comprising:

an elongate handle;

a brush head of planar configuration having a longitudinal axis of symmetry and a transverse axis of symmetry;

said brush head having a first side adapted for mounting a brush thereon;

a ball-retaining socket defined by a plurality of circumferentially and equidistantly spaced apart retainers formed on a second of said brush head, each of said retainers having a radially inwardly directed curvature;

a plurality of handle-receiving spaces defined between circumferentially adjacent pairs of retainers, each of said spaces adapted to slidingly receive said elongate handle when said elongate handle is positioned at an acute angle relative to a plane of said brush head;

a ball disposed in surrounded and captured relation to said retainers, said ball being freely rotatable within said socket;

a first bore formed in said ball for receiving a distal end of said elongate handle;

a quick release means enabling quick connection and disconnection of said distal end of said elongate handle and said ball;

whereby said handle slidingly moves within a preselected space as said brush is used; and whereby rotation of said brush head relative to said longitudinal axis of said elongate handle is prevented when said elongate handle is slideably positioned within said preselected space.

2. The assembly of claim 1, further comprising:

a hand-held handle for releasably engaging said socket when said elongate handle is disengaged from said ball.

3. The assembly of claim 2, wherein said hand-held handle includes a plurality of curved fingers that releasably fit within said spaces between said retainers so that when said elongate handle is disengaged from said ball, said hand-held handle may be placed into releasable engagement with said socket.

4. The assembly of claim 3, wherein said fingers are integral with one another at respective proximal ends thereof and wherein said hand-held handle has a generally hemispherical shape.

5. The assembly of claim 1, wherein said quick release means includes a throughbore formed in said ball and a self-biased locking device positioned within a hollow interior of said elongate handle, said self-biased locking device including a first pin that extends through a first aperture formed in said elongate handle and into said throughbore when said self-biased locking device is in repose, and further including a second pin that extends through a second aperture in said elongate handle when said self-locking device is in repose, said first pin withdrawing from said throughbore and unlocking said elongate handle from said ball when said second pin is manually depressed, said second pin and said second aperture being positioned in longitudinally spaced apart relation to said ball and socket.

6. The assembly of claim 5, wherein said throughbore formed in said ball has an axis of symmetry normal to an axis of symmetry of said blind bore formed in said ball.

7. The assembly of claim 1, further comprising a truncate upstanding post formed in a bottom of said ball-retaining socket, centrally thereof, and a first groove formed in said ball, said first groove adapted to slideably receive said post so that said elongate handle is free to rotate in a plane defined by a longitudinal axis of said groove but is not free to rotate in a plane normal thereto.

8. The assembly of claim 7, wherein said groove follows a path of travel that describes a great circle route around said ball, said groove extending only about half way around said ball, and said groove being formed in said ball on a side opposite said blind bore.

9. The assembly of claim 7, further comprising a second groove formed in said ball, said second groove intersecting said first groove at a ninety degree angle, said second groove being adapted to slideably receive said post so that said elongate handle is free to rotate in a plane defined by a longitudinal axis of said groove but is not free to rotate in a plane normal thereto.

10. The assembly of claim 9, wherein said second groove follows a path of travel that describes a great circle route around said ball, said second groove extending only about half way around said ball, and said second groove being formed in said ball on a side opposite said blind bore.

* * * * *